US005803396A

United States Patent [19]

Dewaele

[11] Patent Number: 5,803,396

[45] Date of Patent: Sep. 8, 1998

[54] METHOD FOR SPOOLING A STRIP OF WIRES, AND A SPOOLED STRIP OF WIRES

[75] Inventor: Christiaan Dewaele, Avelgem, Belgium

[73] Assignee: N.V. Bekaert S.A., Zwevegem, Belgium

[21] Appl. No.: 875,290

[22] PCT Filed: Feb. 19, 1996

[86] PCT No.: PCT/EP96/00715

§ 371 Date: Jul. 23, 1997

§ 102(e) Date: Jul. 23, 1997

[87] PCT Pub. No.: WO96/26881

PCT Pub. Date: Sep. 6, 1996

[30] Foreign Application Priority Data

Feb. 27, 1995 [BE] Belgium ..... 9500168

[51] Int. Cl.[6] ..... B65H 18/00

[52] U.S. Cl. ..... 242/532.6; 242/118.6; 242/608.4; 242/609

[58] Field of Search ..... 242/532.6, 608.4, 242/609, 610.1, 610.5, 613, 614, 118.6, 118.61, 530, 530.1, 530.3, 530.4, 532.3, 532.5

[56] References Cited

U.S. PATENT DOCUMENTS

| | | | |
|---|---|---|---|
| 2,096,965 | 10/1937 | Howsam | 242/118.6 |
| 2,225,551 | 12/1940 | Clinton | 242/118.6 |
| 2,365,213 | 12/1944 | Packtor | 242/530.4 |
| 2,726,051 | 12/1955 | Deichert | 242/530.3 |
| 2,746,692 | 5/1956 | Wijchman | 242/609 |
| 2,755,029 | 7/1956 | Speed et al. | 242/530.1 |
| 3,061,226 | 10/1962 | Kegg | 242/530.1 |
| 3,406,924 | 10/1968 | Bruns et al. | 242/530.1 |
| 3,567,149 | 3/1971 | Williamson | 242/532.6 |
| 4,026,491 | 5/1977 | Bostroem | 242/530.3 |
| 4,039,156 | 8/1977 | Abraham | 242/608.4 |
| 4,093,140 | 6/1978 | Matsunaga | 242/530.1 |
| 4,133,491 | 1/1979 | Yamazaki et al. | 242/530.4 |
| 4,201,352 | 5/1980 | Madachy | 242/530.1 |
| 4,293,101 | 10/1981 | Dunaevsky et al. | 242/530.4 |
| 4,412,661 | 11/1983 | Wise et al. | 242/608.4 |
| 4,421,283 | 12/1983 | Rippin | 242/530.1 |
| 4,593,864 | 6/1986 | Stromme | 242/530.3 |
| 4,840,322 | 6/1989 | Masuda et al. | 242/532.6 |
| 5,078,001 | 1/1992 | Bakermans | 242/530 |
| 5,490,639 | 2/1996 | Droutsas | 242/530.3 |

FOREIGN PATENT DOCUMENTS

| | | | |
|---|---|---|---|
| 796955 | 9/1973 | Belgium . | |
| 2222151 | 10/1974 | France . | |
| 26 32 719 | 1/1978 | Germany . | |
| 1093533 | 12/1967 | United Kingdom | 242/614 |

OTHER PUBLICATIONS

Research Disclosure, No. 3343, Nov. 1992, pp. 831–834 XP 000324089 34337: "Fixing of Ends to Spool".

*Primary Examiner*—John P. Darling
*Attorney, Agent, or Firm*—Shlesinger, Arkwright & Garvey LLP

[57] ABSTRACT

Method of winding a strip of material includes providing a reel having a first flange and a second flange, with a core disposed between the first and second flanges. A cross groove is provided in the core, the cross groove being configured for receiving a strip of material therein. A strip of material is then provided in the cross groove. The strip of material may be a strip of the type having a plurality of wires disposed adjacent to each other. The plurality of wires may be glued together. One or more pegs may be provided to connect the first flange to the second flange. A tube may be provided in order to receive the peg. A spool of such wound strip material includes first and second flanges spaced apart by a core. A cross groove provided in the core receives a leading end of a strip of material.

20 Claims, 1 Drawing Sheet

METHOD FOR SPOOLING A STRIP OF WIRES, AND A SPOOLED STRIP OF WIRES

Figure 1:
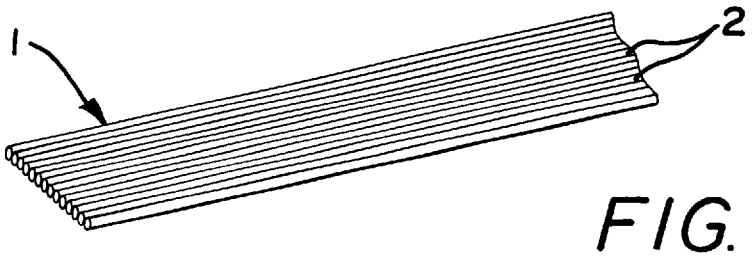

The invention relates to a method for spooling a strip of wires, placed next to each other on a reel, whereby the reel consists of a core and two flanges.

The spooling of a strip or band of wires, placed next to each other, is now usually done by fixing the leading end of the strip to the core of the reel by means of strips of adhesive tape. Such a strip or band of wires, placed next to each other, is e.g. described in the Belgian patent no. 796.955 of applicant N. V. BEKAERT S. A. Such a strip can e.g. consist of 100 to 200 wires, placed next to each other, in which the wires show an almost rectangular cross section.

The wires are preferably held together with glue.

A first disadvantage of the present method for fixing the leading end of the strip of wires placed next to each other, to the core of the reel, is that it is necessary to fix the beginning of it by means of strips of adhesive tape, which is rather cumbersome and timewasting. Besides, this method requires the use of adhesive tape.

A second disadvantage of the present method is that the extremities of the wires, placed next to each other, form a very sharp extremity. When spooling and paying off the strip of wires, placed next to each other on the core of the reel, this sharp extremity can damage the adjoining windings.

The object of the invention is to eliminate the above-mentioned disadvantages.

For this purpose the invention learns, in case of a method of the type mentioned in the beginning, that a reel is taken, of which the core is provided with at least one cross groove, that the leading end of the strip of wires placed next to each other is placed into the cross groove, and that next, the spooling of the successive windings of the strip on the reel is continued.

An advantage of the method according to the invention is, that it is no longer necessary to fasten the leading end of the strip to the core of the reel by means of adhesive tape.

Another important advantage of the method, according to the invention, is that the sharp leading end of the strip of wires, placed next to each other, is completely taken up in the core, through which the cutting effect of it on the other successive windings is completely eliminated.

Preferably a reel, of which the core consists of a number of almost identical parts and whereby a cross groove is formed each time between each pair of adjoining core parts, is taken.

Figure 2:
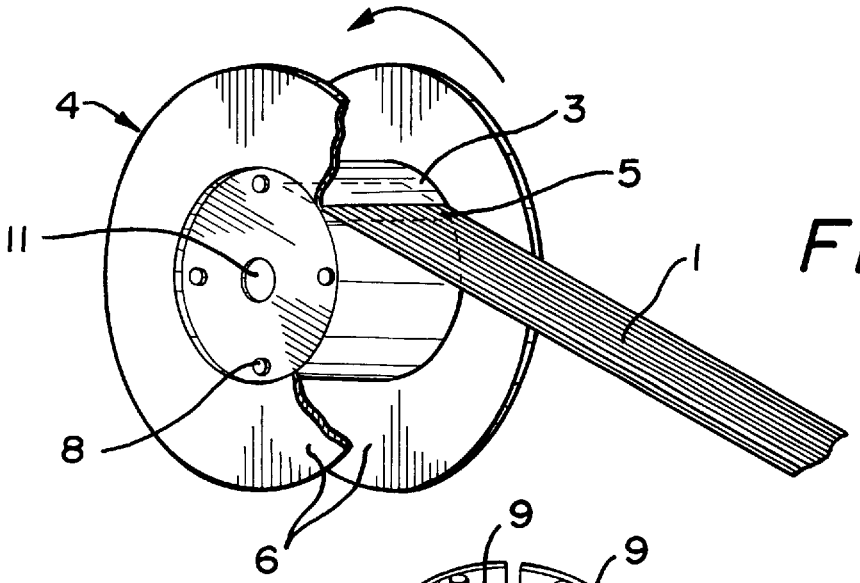
Figure 3:
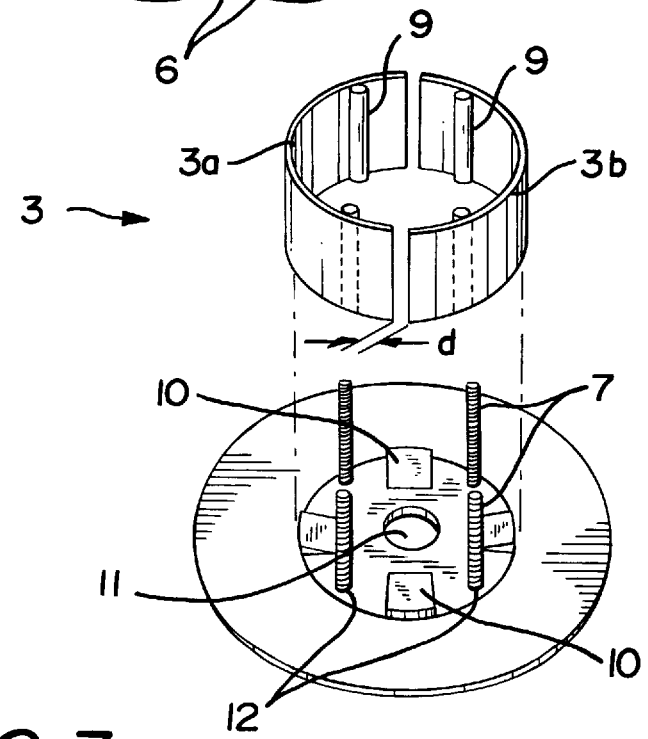

The invention will be further illustrated in the following description, on the basis of the corresponding drawing. In the drawing are shown:

FIG. 1 in perspective, part of a strip of wires, placed next to each other;

FIG. 2 in perspective, the fixing of the beginning of the wires, placed next to each other, to the core of the reel, and FIG. 3 in perspective, the placing of the core parts to a flange of the reel.

FIG. 1 shows in perspective part of a strip 1 of wires 2 placed next to each other. The width of the strip or band 1 can e.g. vary from 100 to 200 mm. The strip 1 consists e.g. of 100 to 200 steel wires placed next to each other. in which the steel wires present an almost rectangular cross section. The dimensions of the rectangular cross section of each wire are e.g. 0.95 mm to 0.64 mm. The wires 2 are preferably glued to each other. Such strips of glued steel wires are used in particular for the making of staples. As already mentioned, such a band or strip 1 of steel wires is already described in the Belgian patent no. 796.955 of applicant N. V. BEKAERT S. A.

FIG. 2 shows in perspective how the leading end of the strip 1 of the steel wires 2 placed next to each other is being fixed to the core 3 of the reel 4. For this purpose, a reel or spool 4 is taken, of which the core 3 is at least provided with one cross groove 5, and the beginning of the strip 1 is placed into the cross groove 5. Preferably, the cross groove 5 extends to the distance between the two flanges 6 of the reel 4, and the width of the strip is a little smaller than the distance between the flanges 6. After the fixing of the leading end of the strip 1, the successive windings of the strip 1 are spooled on the reel 4. The fixing of the trailing end of the strip 1 of the last winding is done by means of adhesive tape, binding wire or other fixing materials.

FIG. 3 shows in perspective the placing of two core parts 3*a*, 3*b* on a flange 6 during the composition of a reel 4, when the core 3*a*, 3*b* of the reel 4 consists of two almost identical core parts 3*a*, 3*b*. The reel 4 consists of two almost identical flanges 6 and two almost identical core parts 3*a*, 3*b* whereby the core parts 3*a*, 3*b* are fixed to the flanges 6 by means of pegs 7 and nuts 8. The two almost identical core parts 3*a*, 3*b* are e.g. made out of steelsheet with a thickness of 2 mm, folded over half a circle circumference with an inner diameter of ±500 mm and a width of ±160 mm. Each core parts 3*a*, 3*b* is provided at two places with a thin tube 9, which is welded to the sheet and which serves for taking up the pegs or threaded rods 7. The flanges 6 are preferably made out of wood and provided with a number of four distance holders 10 to fix the core parts 3*a*, 3*b* on the right place and to support them. The flanges 6 are also provided with a shaft hole 11 and a number of four holes 12 to take up the pegs 7.

It is important to care that the distance d between the edges of the two adjoining core parts 3*a*, 3*b* is big enough to take up the leading end of the strip of wires placed next to each other in the formed cross groove 5. The distance d is preferably about 10 to 20 mm.

Other advantages while using a metal core of at least two core parts consist in the following : when the reels 4 are being dismounted, the core parts 3*a*, 3*b* can be stacked in and upon each other ; which leads to a considerable space-saving when transporting those core parts 3*a*, 3*b*. The flanges 6 can be tightened very securely, because the metal core parts 3*a*, 3*b* are not compressible, which is not the case when using cardboard cores.

All the above-mentioned dimensions are only given as example.

I claim:

1. A method of winding a strip of material, comprising the steps of:

a) providing a reel of the type including:
   i) a first flange and a second flange;
   ii) a core disposed between and separating the first flange from the second flange; and
   iii) a cross groove disposed in the core, the cross groove being configured for receiving a strip of material therein;

b) providing a strip of material of the type including:
   i) a plurality of wires disposed adjacent to each other; and
   ii) the plurality of wires collectively defining a strip of wires having a leading end and a trailing end;

c) inserting the leading end of the strip of wires into the cross groove; and d) winding the strip of wires around the core.

2. A method according to claim 1, wherein:

a) each one of the plurality of wires is glued to another one of the plurality of wires.

3. A method according to claim 1, further comprising the steps of:

a) fixing the leading end of the strip of wires to the reel.

4. A method according to claim 1, wherein:

a) the leading end of the strip of wires is inserted sufficiently into the cross groove so that the outer surface of the core is substantially free of free ends of respective ones of the plurality of wires.

5. A method according to claim 1, wherein:

a) the core includes a first core part and a second core part;

b) the first core part is substantially the same as the second core part; and c) a cross groove is defined between the first core part and the second core part.

6. A method according to claim 1, wherein:

a) the cross groove extends substantially the entire distance between the first flange and the second flange.

7. A method as defined in claim 1, wherein:

a) at least one peg connects said first flange to said second flange;

b) at least one tube is disposed adjacent to at least one of said core parts; and c) said at least one peg is disposed in said at least one tube.

8. A method according to claim 7, wherein:

a) said at least one tube is attached to said at least one core part.

9. A method according to claim 7, wherein:

a) said at least one tube is attached to said at least one core part.

10. A spool of wound strip material, comprising:

a) a reel of the type including:

i) a first flange and a second flange;

ii) a core disposed between and separating the first flange from the second flange; and iii) a cross groove disposed in the core, the cross groove being configured for receiving a strip of material therein;

b) a wound strip of material disposed on said core, said wound strip of material being of the type including:

i) a plurality of wires disposed adjacent to each other; and ii) the plurality of wires collectively defining a strip of wires having a leading end and a trailing end; and c) said leading end of the strip of wires being inserted into the cross groove.

11. A device according to claim 10, wherein:

a) each one of the plurality of wires is glued to another one of the plurality of wires.

12. A device according to claim 10, wherein:

a) said leading end of the strip of wires is fixed to said reel.

13. A device according to claim 10, wherein:

a) the leading end of the strip of wires is inserted sufficiently into the cross groove so that the outer surface of the core is substantially free of free ends of respective ones of the plurality of wires.

14. A device according to claim 10, wherein:

a) the core includes a first core part and a second core part;

b) the first core part is substantially the same as the second core part; and c) a cross groove is defined between the first core part and the second core part.

15. A device according to claim 14, wherein:

a) the first core part is substantially identical to the second core part.

16. A device according to claim 10, wherein:

a) the cross groove extends substantially the entire distance between the first flange and the second flange.

17. A device according to claim 10, wherein:

a) the core includes sheet-like material defining a substantially hollow interior; and b) the leading edge of the strip of wires extends into the substantially hollow interior of the core.

18. A spool of wound strip material, comprising:

a) a reel of the type including:

i) a first flange and a second flange;

ii) a core disposed between and separating the first flange from the second flange; and iii) a cross groove disposed in the core, the cross groove being configured for receiving a strip of material therein;

b) at least one peg connecting said first flange to said second flange;

c) at least one tube disposed adjacent to at least one of said core parts;

d) said at least one peg being disposed in said at least one tube;

e) a wound strip of material disposed on said core, said strip of material being of the type including:

i) a plurality of wires disposed adjacent to each other; and ii) the plurality of wires collectively defining a strip of wires having a leading end and a trailing end; and f) said leading end of the strip of wires being inserted into the cross groove.

19. A device according to claim 18, wherein:

a) each one of the plurality of wires is glued to another one of the plurality of wires.

20. A device according to claim 18, wherein:

a) said leading end of the strip of wires is fixed to said reel.

* * * * *